US011833390B2

(12) United States Patent
Mattox

(10) Patent No.: US 11,833,390 B2
(45) Date of Patent: Dec. 5, 2023

(54) CONTROLLED SQUAT STRENGTH-TRAINING MACHINE

(71) Applicant: Ernest Michael Mattox, Holt, MO (US)

(72) Inventor: Ernest Michael Mattox, Holt, MO (US)

( * ) Notice: Subject to any disclaimer, the term of this patent is extended or adjusted under 35 U.S.C. 154(b) by 0 days.

(21) Appl. No.: 17/973,308

(22) Filed: Oct. 25, 2022

(65) Prior Publication Data

US 2023/0136975 A1 May 4, 2023

Related U.S. Application Data

(60) Provisional application No. 63/273,004, filed on Oct. 28, 2021.

(51) Int. Cl.

| | |
|---|---|
| ***A63B 23/04*** | (2006.01) |
| ***A63B 21/00*** | (2006.01) |
| ***A63B 21/04*** | (2006.01) |
| ***A63B 21/055*** | (2006.01) |
| ***A63B 21/002*** | (2006.01) |

(52) U.S. Cl.

CPC ..... *A63B 23/04* (2013.01); *A63B 21/002* (2013.01); *A63B 21/0407* (2013.01); *A63B 21/0557* (2013.01); *A63B 21/154* (2013.01); *A63B 21/4015* (2015.10); *A63B 21/4035* (2015.10); *A63B 21/4039* (2015.10); *A63B 2023/0411* (2013.01); *A63B 2230/01* (2013.01)

(58) Field of Classification Search

CPC ..... A63B 23/04; A63B 21/002; A63B 21/0407; A63B 21/0557; A63B 21/154; A63B 21/4015; A63B 21/4035; A63B 21/4039; A63B 2023/0411; A63B 2230/01

See application file for complete search history.

(56) References Cited

U.S. PATENT DOCUMENTS

| | | | | |
|---|---|---|---|---|
| 5,637,063 | A * | 6/1997 | Fuller, Sr. | A63B 69/34 482/137 |
| 7,029,426 | B1 * | 4/2006 | Fuller, Sr. | A63B 21/4047 482/137 |
| 7,470,221 | B1 * | 12/2008 | Ramos | A63B 21/4035 482/904 |
| 8,147,389 | B1 * | 4/2012 | Hoole | A63B 23/1227 482/37 |
| 10,220,233 | B2 * | 3/2019 | Schmidt | A63B 21/00065 |
| 10,792,532 | B1 * | 10/2020 | Hall | A63B 21/062 |
| 11,235,194 | B2 * | 2/2022 | Parker | A63B 21/4009 |
| 2007/0197353 | A1 * | 8/2007 | Hundley | A63B 21/4047 482/93 |
| 2017/0203149 | A1 * | 7/2017 | D'Amico | A63B 21/0615 |
| 2020/0038704 | A1 * | 2/2020 | Adams | A63B 21/4009 |
| 2020/0094099 | A1 * | 3/2020 | Kelly | A63B 21/0609 |

* cited by examiner

*Primary Examiner* — Andrew S Lo
(74) *Attorney, Agent, or Firm* — Law Office of Mark Brown, LLC; Mark E. Brown

(57) ABSTRACT

A controlled squat strength-training machine includes a frame with a base mounting forward, intermediate, and rear uprights. The intermediate upright is pivotally connected to the base and is configured for limited rotation fore-and-aft. Knee pads are provided for restraining of users' knees. Users can adjust the resistance of the machine and thereby very the exercises performed thereon.

14 Claims, 4 Drawing Sheets

CONTROLLED SQUAT STRENGTH-TRAINING MACHINE

CROSS-REFERENCE TO RELATED APPLICATION

This application claims priority in U.S. Provisional Patent Application No. 63/273,004, filed Oct. 28, 2021, which is incorporated herein by reference.

BACKGROUND OF THE INVENTION

1. Field of the Invention

The present invention relates generally to exercise equipment, and in particular to a strength-training machine for performing squats with variable resistance through a controlled range-of-movement (ROM) for dynamic positioning.

2. Description of the Related Art

Physical training (PT) exercises can be performed with free weights, such as barbells, dumbbells, etc. Moreover, individuals can strength-train using their own body weight in exercises such as push-ups, pull-ups, etc. Exercise machines are available for performing various resistance training exercises within controlled ranges-of-movement (ROMs) with adjustable resistance. However, previously, there has not been available a squat strength-training machine with the advantages and features of the present invention, including stabilizing a user's knee joints throughout the squat (ROM) exercise.

Squat exercises are performed by individuals raising and lowering themselves between standing and squatting positions. Squats strengthen several muscle groups, including quadriceps in the legs and erectors in the back. Greater strength can be achieved by performing squats with free weights, such as barbells resting on the shoulders and by participants holding dumbbells. By using free weights, the strength-training benefits are increased. However, participants using unrestrained free weights are susceptible to injuries, particularly to the knees. Risks of injuring or "blowing out" knees increase as individuals perform squats with greater weights. Such injuries can range from minor strains of the muscles and ligaments to tears and separations. Extensive injuries can necessitate medical treatment and, in severe cases, surgical repair of damaged muscles and ligaments.

Heavy lifts, including squats, are often done in the presence of another individual, i.e., a "spotter." Spotters can catch a barbell in the event an individual is unable to complete the exercise due to excessive weight, fatigue, muscle cramping, etc. Alternatively, squat cages and similar equipment are available for controlling ranges of movement and reducing injury risks to users.

Resistance training equipment using springs and elasticized bands as resistance elements are also available. Variable resistance can be achieved by using springs and bands with different expansion-contraction characteristics, and by using multiple resistance elements.

Previously, there has not been available a dynamic-positioning, knee-stabilizing, motion-limiting, squat-training machine with the advantages and features of the present invention.

SUMMARY OF THE INVENTION

The present invention includes a frame configured for placement on a flat surface. The individual participant starts in a sitting position and rises to a standing position while gripping a T-bar to perform a squat. One or more elasticized resistance bands stretch through the range of motion. The machine includes pads configured for supporting an individual and restraining him or her throughout the squat motion. The resistance bands, pads and other frame elements are adjustable for repositioning as necessary to optimize the exercise benefit.

BRIEF DESCRIPTION OF THE DRAWINGS

The drawings constitute a part of this specification and include exemplary embodiments of the present invention illustrating various objects and features thereof.

DETAILED DESCRIPTION OF THE PREFERRED EMBODIMENTS

I. Introduction and Environment

As required, detailed aspects of the present invention are disclosed herein, however, it is to be understood that the disclosed aspects are merely exemplary of the invention, which may be embodied in various forms. Therefore, specific structural and functional details disclosed herein are not to be interpreted as limiting, but merely as a basis for the claims and as a representative basis for teaching one skilled in the art how to variously employ the present invention in virtually any appropriately detailed structure.

Certain terminology will be used in the following description for convenience in reference only and will not be limiting. For example, up, down, front, back, right, and left refer to the invention as orientated in the view being referred to. The words "inwardly" and "outwardly" refer to directions toward and away from, respectively, the geometric center of the aspect being described and designated parts thereof. Said terminology will include the words specifically mentioned, derivatives thereof and words of similar meaning.

II. Controlled Squat Strength-Training Machine 2

Figure 1:
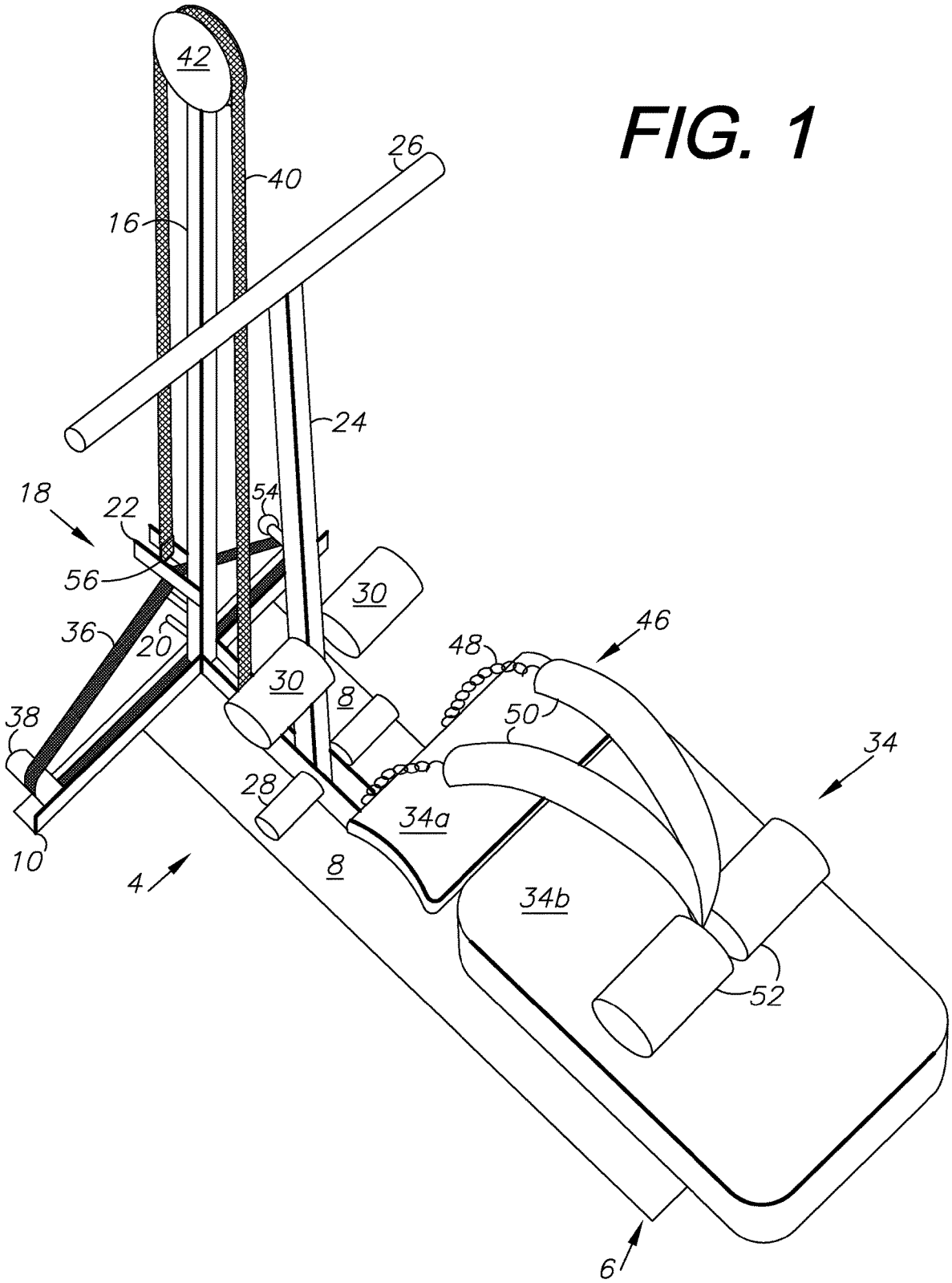
FIG. 1 is a partial, perspective view of a front portion of a controlled squat strength-training machine embodying an aspect or embodiment of the present invention.
Figure 2:
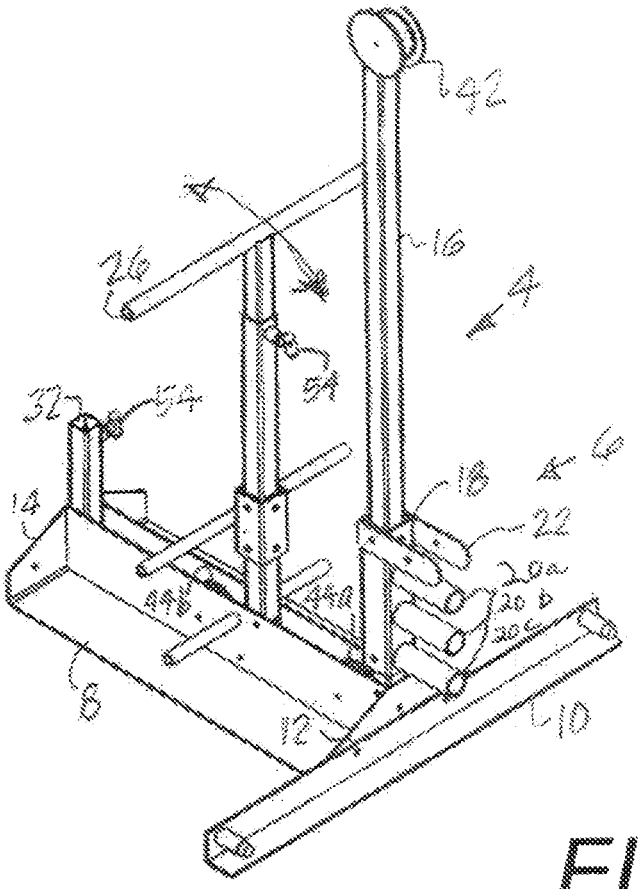
FIG. 2 shows portions of the machine, including: the base frame; the vertical standard with a vertically-sliding traveler, an upper band pulley; a T-bar assembly; and a rear upright for vertically-adjustably mounting a bench.

Referring to the drawings more detail, FIGS. 1-2 show an embodiment or aspect of the present invention comprising a controlled squat strength-training machine, which is generally designated by the reference numeral 2. The machine 2 includes a frame 4 with a base 6, including a pair of longitudinal angle sections 8 and a front, transverse angle section 10. The frame 4 also includes front and back gussets 12, 14.

A front upright 16 is attached to the front gussets 12 and the front ends of the longitudinal angle sections 8. The front upright mounts a traveler 18, which is vertically slidably movable thereon and includes multiple (e.g., 3 are shown) upper, intermediate, and lower rods 20*a*, 20*b*, 20*c* respectively, which extend forwardly from the traveler 18. A pair of forwardly-extending traveler arms 22 are positioned above the rods 20*a*, 20*b* and 20*c*.

An intermediate upright 24 is pivotally connected to the longitudinal angle sections 8 and telescopically, vertically-adjustably mounts a generally horizontal grip bar 26. The intermediate upright 24 also mounts a pair of knee pads or restraints 30.

A pair of padded foot restraints 28 are connected to the longitudinal angle sections 8 and are configured for engagement by a user to facilitate proper foot position and alignment. A rear upright 32 is connected to the longitudinal angle sections 8 and the rear gusset 14. The rear upright 32 adjustably mounts a seat assembly 34 comprising a front, knee-engaging component 34*a* and a rear seat component 34*b*.

An elastomeric resistance band 36 is attached to the transverse angle section 10 by a pair of forwardly-extending resistance band anchors 38. A lifting strap 40 is anchored at 56 to the traveler arms 22, passes over an upper pulley 42, passes under front and back lower pulleys 44*a*, 44*b* respectively and terminates at a yoke assembly 46. The yoke assembly 46 includes a chain 48, which mounts a padded yoke 50 configured for placement over a user's shoulders and supporting a pair of pads 52 for placement on a user's neck. The knee pads or restraints 30 engage the user's legs, preferably in proximity to the knees.

The components of the strength-training machine are adjustable to accommodate various users through squat exercises with different ranges-of-motion. For example, telescoping tubes can be secured in place by locking pins 54. Moreover, multiple resistance bands 36, with different resistance characteristics, can be utilized for increasing or decreasing lifting resistance. The resistance band 36 offers greater resistance when placed over the uppermost rod 20*a* and the least resistance when placed over the lowermost rod 20*c*. The yoke assembly connecting chain 48 enables adjustment to accommodate users of different heights.

III. Alternative Embodiments

Figure 3:
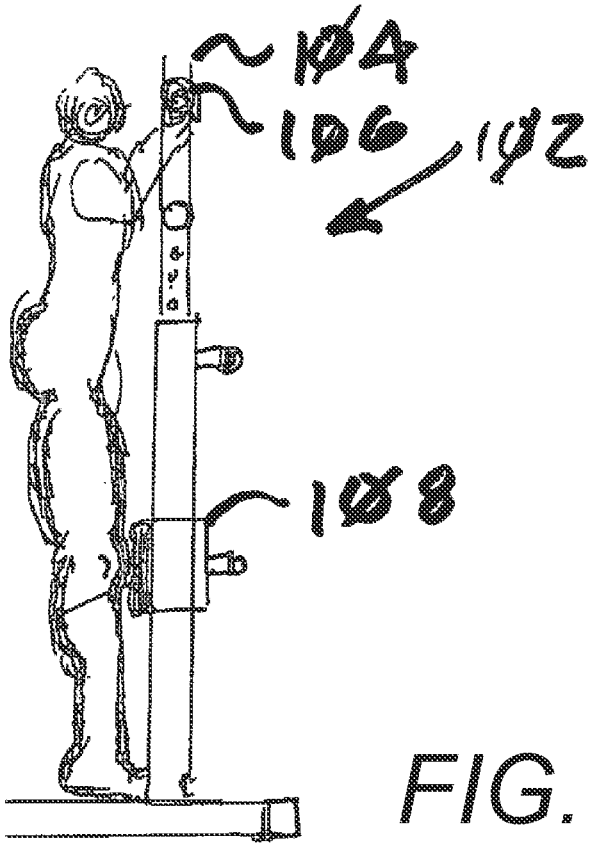
FIG. 3 is a side elevation, showing an alternative embodiment of the present invention with a user in an upright, standing position with his or her knees engaging a knee pad.
Figure 4:
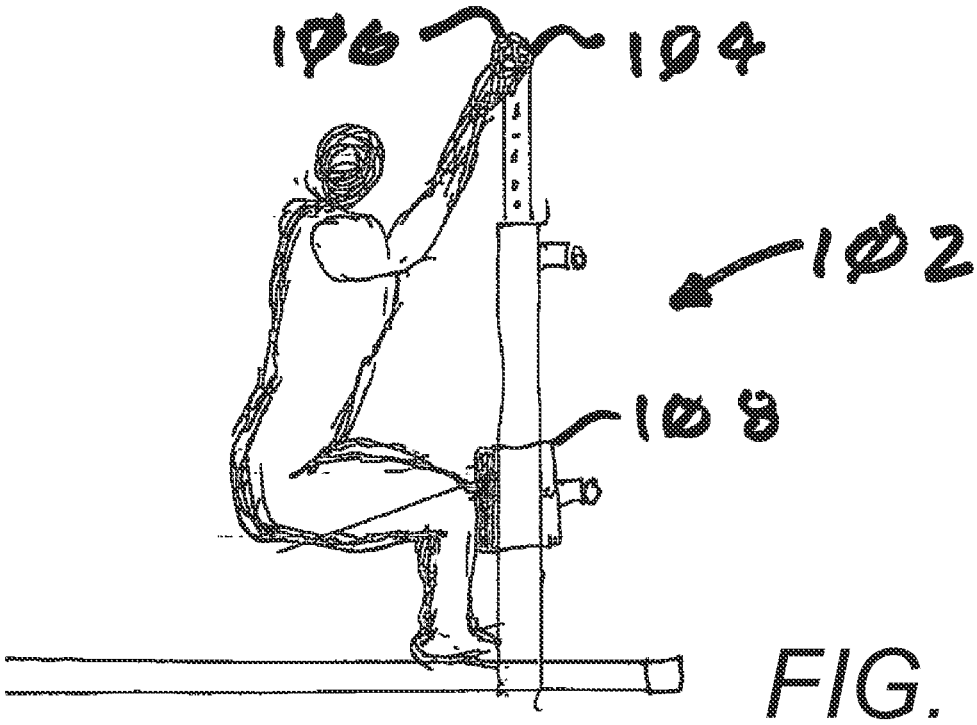
FIG. 4 is another side elevation, showing a user in a squatting position with his or her knees engaging the knee pad.

FIGS. 3-4 show a controlled squat strength-training machine comprising a first alternative aspect or embodiment of the present invention with a modified upright 104, grip bar assembly 106 and knee pad assembly 108. The strength-training machine 102 enables strength-training squats using the bodyweight of the user. The user's body weight can be supplemented with weights, e.g., a weight vest.

Figure 5:
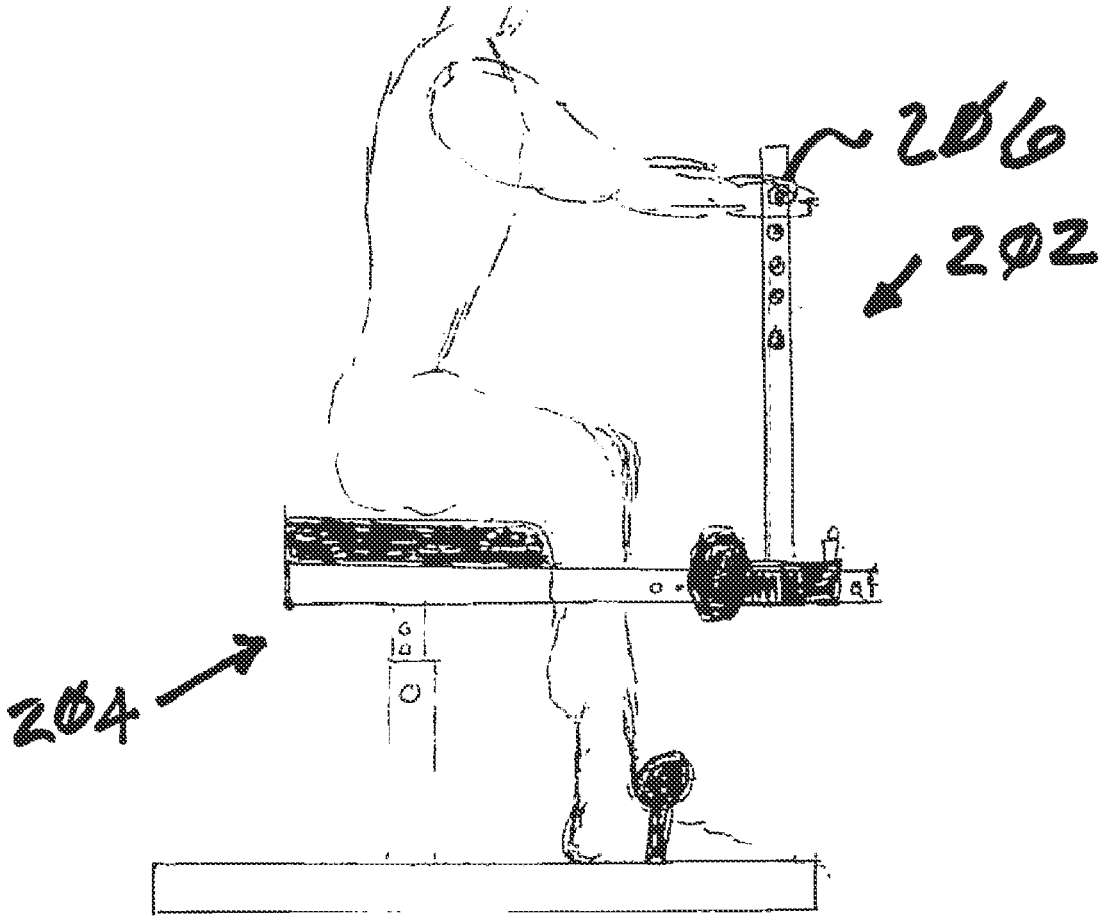
FIG. 5 is a side elevation of another alternative embodiment of the present invention with a user in a seated position.

FIG. 5 shows a controlled squat strength-training machine comprising a second alternative aspect or embodiment of the present invention with a modified seat assembly 204. The user can pull himself or herself up by grasping a grip bar assembly 206.

IV. Conclusion

It is to be understood that the invention can be embodied in various forms and is not to be limited to the examples specifically discussed above. The range of components and configurations which can be utilized in the practice of the present invention is virtually unlimited.

Having thus described the invention, what is claimed as new and desired to be secured by Letters Patent is:

1. A controlled squat strength-training machine comprising:

a frame including a base configured for placement on a support surface;

a first upright with a lower end fixedly connected to said base, said first upright extending upwardly from said base and terminating at a first upright upper end;

a second upright with an intermediate upright lower end pivotally connected to the base, said second upright extending upwardly from said base and terminating at an second upright upper end, said second upright configured for pivotal movement fore-and-aft relative to the base;

a third upright fixedly connected to said base and extending upwardly therefrom, said third upright terminating at a third upright upper end;

a traveler assembly vertically-slidably mounted on said first upright;

an upper pulley mounted on said first upright upper end;

a resistance band connected to said base and said traveler, said resistance band configured for stretching when the traveler moves upwardly on said first upright;

a grip bar mounted on said second upright upper end and configured for grasping by a user;

a knee pad assembly mounted on said second upright and configured for engagement by a user in proximity to the user's knees;

front and back lower pulleys rotatably mounted on said base;

a strap connected to said traveler, extending over said upper pulley, extending below said lower pulleys and terminating at a strap rear end;

a yoke assembly including: a chain connected to said strap rear end; and a yoke connected to the chain and configured for engaging a user behind his or her neck;

a seat assembly mounted on said third upright upper end; and said machine configured for restraining a user's knees during a squat exercise starting with the user seated on the seat assembly with his or her knees engaging the knee pad assembly, the user stretching the resistance band through the standing portion of a squat exercise while his or her knees remain engaged with the knee pad assembly.

2. The strength-training machine according to claim 1, wherein said frame includes:

a pair of longitudinal angle sections with front and rear ends, said longitudinal angle sections positioned in generally horizontal, parallel, spaced relation;

said first, second and third uprights comprising front, intermediate, and rear uprights mounted at their respective lower ends to said longitudinal angle sections, with said upright lower ends located between said longitudinal angle sections;

a front transverse section attached to said longitudinal angle sections at their front ends; and a rear transverse section attached to said longitudinal angle sections at their rear ends.

3. The strength-training machine, according to claim 2, which includes:

a pivot bolt extending through said longitudinal angle sections and said intermediate upright lower end; and said frame configured for restricting fore-and-aft pivotal movement of said intermediate upright.

4. The strength-training machine, according to claim 3, which includes:

a pair of foot restraints mounted on said longitudinal angle sections and configured for engagement with a user's feet for restraining the user's legs.

5. The strength-training machine, according to claim 4, which includes:

said traveler assembly having multiple rods extending forwardly therefrom and configured for adjusting a vertical lifting resistance of said traveler assembly.

6. The strength-training machine according to claim 1, which includes:

said traveler assembly including a pair of forwardly-extending arms; and a lifting strap anchor extending between said traveler assembly arms and configured for anchoring a front end of said lifting strap.

7. The strength-training machine, according to claim 2, wherein said frame includes a pair of resistance band anchors each mounted on a respective end of said front transverse section and configured for removable connection to a respective resistance band end.

8. The strength-training machine, according to claim 1, wherein said seat assembly comprises a front seat section configured for engaging a user's knees and a rear seat section configured for supporting said user in a sitting position at the beginning of a lift exercise.

9. The strength-training machine, according to claim 1, wherein said yoke assembly includes a pad configured for engaging a user's neck.

10. A controlled squat strength-training machine comprising:

a frame including a base configured for placement on a support surface;

a front upright with a lower end fixedly connected to said base, said front upright extending upwardly from said base and terminating at a front upright upper end;

an intermediate upright with an intermediate upright lower end pivotally connected to the base, said intermediate upright extending upwardly from said base and terminating at an intermediate upright upper end, said intermediate upright configured for pivotal movement fore-and-aft relative to the base;

a rear upright fixedly connected to said base and extending upwardly therefrom, said rear upright terminating at a rear upright upper end;

a traveler assembly vertically-slidably mounted on said front upright;

an upper pulley mounted on said front upright upper end;

a resistance band connected to said base and said traveler, said resistance band configured for stretching when the traveler moves upwardly on said front upright;

a grip bar mounted on said intermediate upright upper end and configured for grasping by a user;

a knee pad assembly mounted on said intermediate upright and configured for engagement by a user in proximity to the user's knees;

front and back lower pulleys rotatably mounted on said base;

a strap connected to said traveler, extending over said upper pulley, extending below said lower pulleys and terminating at a strap rear end;

a yoke assembly including: a chain connected to said strap rear end; and a yoke connected to the chain and configured for engaging a user behind his or her neck;

a seat assembly mounted on said rear upright upper end;

said machine configured for restraining a user's knees during a squat exercise starting with the user seated on the seat assembly with his or her knees engaging the knee pad assembly, the user stretching the resistance band through the standing portion of a squat exercise while his or her knees remain engaged with the knee pad assembly;

said frame including a pair of longitudinal angle sections with front and rear ends, said longitudinal angle sections positioned in generally horizontal, parallel, spaced relation;

said front, intermediate, and rear uprights mounted at their respective lower ends to said longitudinal angle sections, with said upright lower ends located between said longitudinal angle sections;

a front transverse section attached to said longitudinal angle sections at their front ends;

a rear transverse section attached to said longitudinal angle sections at their rear ends;

a pivot bolt extending through said longitudinal angle sections and said intermediate upright lower end;

said frame configured for restricting fore-and-aft pivotal movement of said intermediate upright;

a pair of foot restraints mounted on said longitudinal angle sections and configured for engagement with a user's feet for restraining the user's legs;

said traveler assembly having multiple rods extending forwardly therefrom and configured for adjusting a vertical lifting resistance of said traveler assembly;

said traveler assembly including a pair of forwardly-extending arms; and a lifting strap anchor extending between said traveler assembly arms and configured for anchoring a front end of said lifting strap.

11. The strength-training machine, according to claim 10, wherein said frame includes a pair of resistance band anchors each mounted on a respective end of said front transverse section and configured for removable connection to a respective resistance band end.

12. The strength-training machine, according to claim 10, wherein said seat assembly comprises a front seat section configured for engaging a user's knees and a rear seat section configured for supporting said user in a sitting position at the beginning of a lift exercise.

13. The strength-training machine, according to claim 10, wherein said yoke assembly includes a pad configured for engaging a user's neck.

14. A controlled squat strength-training method comprising the steps of:

providing a frame including a base configured for placement on a support surface;

providing a front upright with a lower end fixedly connected to said base, said front upright extending upwardly from said base and terminating at a front upright upper end;

providing an intermediate upright with an intermediate upright lower end pivotally connected to the base, said intermediate upright extending upwardly from said base and terminating at an intermediate upright upper end, said intermediate upright configured for pivotal movement fore-and-aft relative to the base;

providing a rear upright fixedly connected to said base and extending upwardly therefrom, said rear upright terminating at a rear upright upper end;

providing a traveler assembly vertically-slidably mounted on said front upright;

providing an upper pulley mounted on said front upright upper end;

providing a resistance band connected to said base and said traveler, said resistance band configured for stretching when the traveler moves upwardly on said front upright;

providing a grip bar mounted on said intermediate upright upper end and configured for grasping by a user;

providing a knee pad assembly mounted on said intermediate upright and configured for engagement by a user in proximity to the user's knees;

providing front and back lower pulleys rotatably mounted on said base;

providing a strap connected to said traveler, extending over said upper pulley, extending below said lower pulleys and terminating at a strap rear end;

providing a yoke assembly including: a chain connected to said strap rear end; and a yoke connected to the chain and configured for engaging a user behind his or her neck;

providing a seat assembly mounted on said rear upright upper end; and configuring said machine for restraining a user's knees during a squat exercise starting with the user seated on the seat assembly with his or her knees engaging the knee pad assembly, the user stretching the resistance band through the standing portion of a squat exercise while his or her knees remain engaged with the knee pad assembly.

* * * * *